United States Patent [19]

McGinnis

[11] Patent Number: 4,866,893

[45] Date of Patent: Sep. 19, 1989

[54] EXTENSIBLE MAST

[75] Inventor: Henry J. McGinnis, Fort Worth, Tex.

[73] Assignee: Rapid Deployment Towers, Inc., Azle, Tex.

[21] Appl. No.: 178,563

[22] Filed: Apr. 7, 1988

[51] Int. Cl.[4] ..... E04H 12/00

[52] U.S. Cl. ..... 52/108; 52/118; 52/632; 52/745

[58] Field of Search ..... 52/108, 111, 118, 632, 52/745; 182/42; 242/54 A

[56] References Cited

U.S. PATENT DOCUMENTS

| | | | |
|---|---|---|---|
| 2,130,993 | 9/1938 | Dubilier | 52/108 |
| 3,016,988 | 1/1962 | Browning | 52/108 |
| 3,033,529 | 5/1962 | Pierrat | 254/173 |
| 4,625,475 | 12/1986 | McGinnis | 52/108 |

*Primary Examiner*—James L. Ridgill, Jr.
*Attorney, Agent, or Firm*—James E. Bradley

[57] ABSTRACT

An extensible mast is shown which is erected from a portable base having a plurality of tape reels mounted thereon. The tape reels are angularly oriented on the base with respect to a common, vertical axis, and each of the tape reels is adapted to receive a resilient metal tape having longitudinal edges for winding and unwinding the tape. A plurality of guide rollers on the base receive the respective longitudinal edges of the metal tapes and orient the tapes whereby the tapes are fed upwardly in plane parallel to the vertical axis and at an angle to each other to form a rigid structure. A geared winding mechanism is located above the guide rollers and includes a plurality of rotatable windings which rotate about the vertical axis and wrap and wrap material about the rigid structure to reinforce the structure as it is being erected.

13 Claims, 8 Drawing Sheets

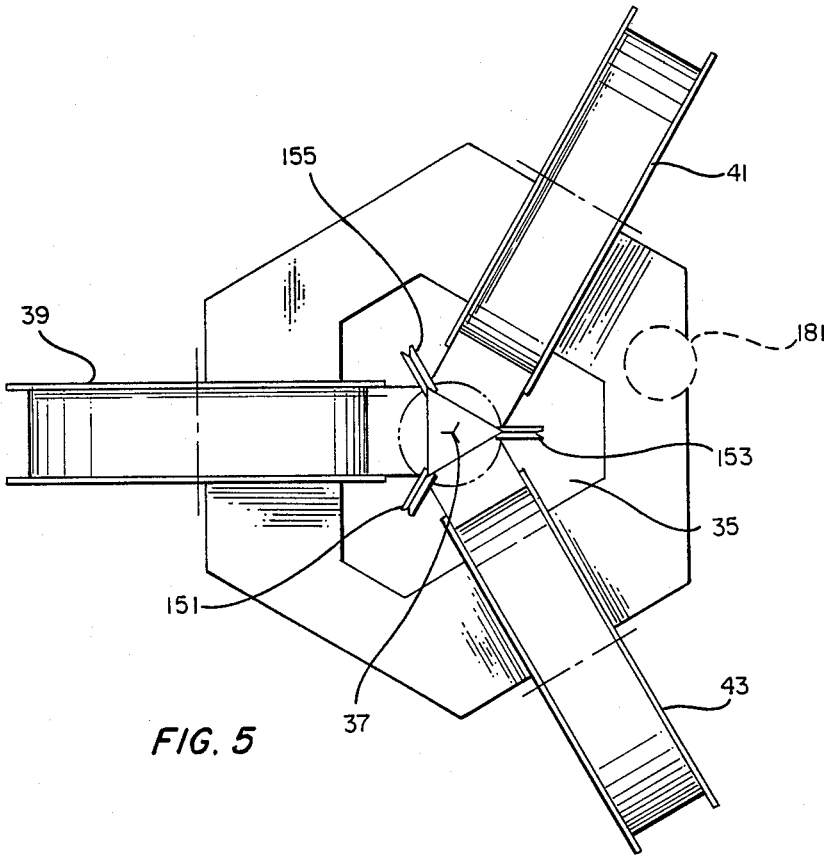
FIG. 5
FIG. 6
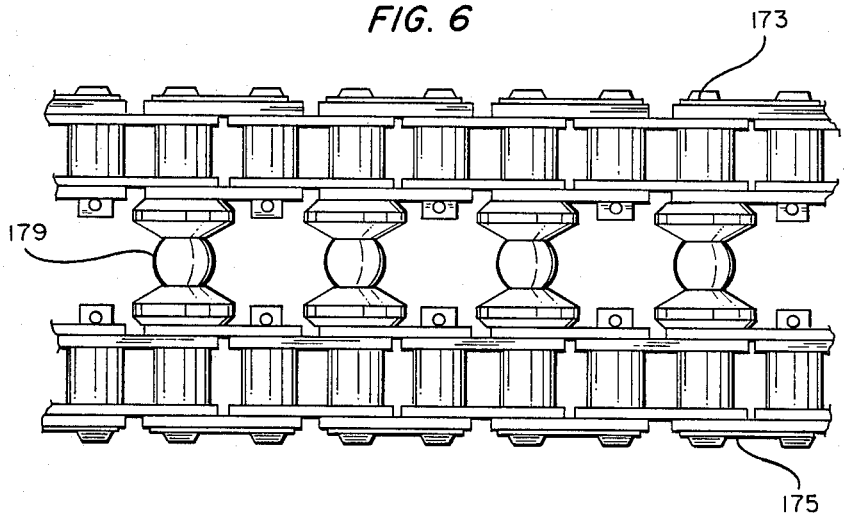

FIG. 11
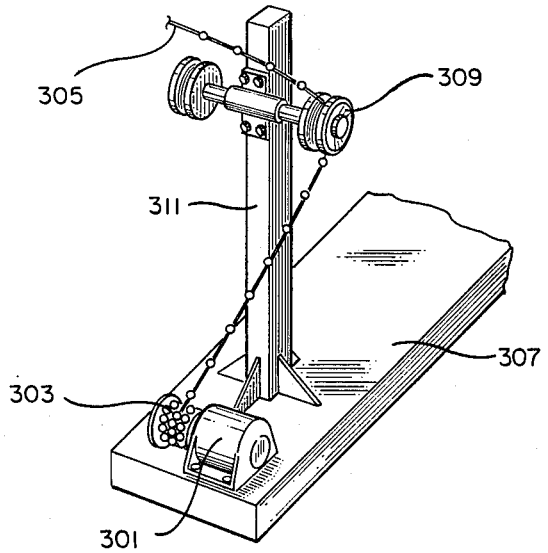
FIG. 12
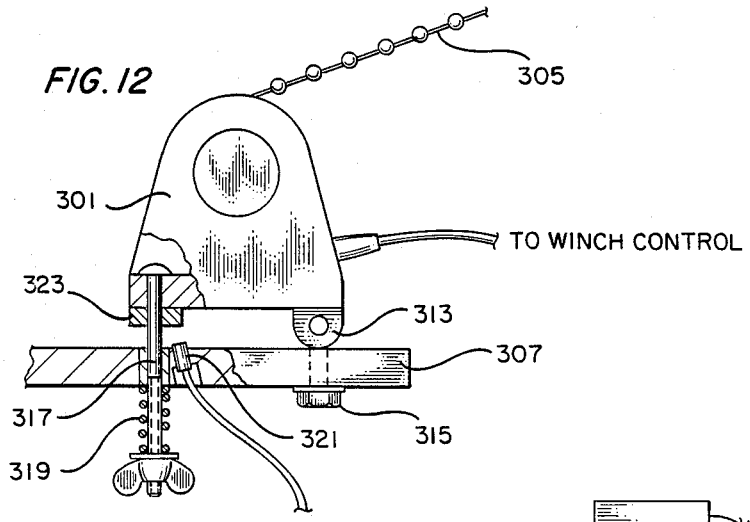
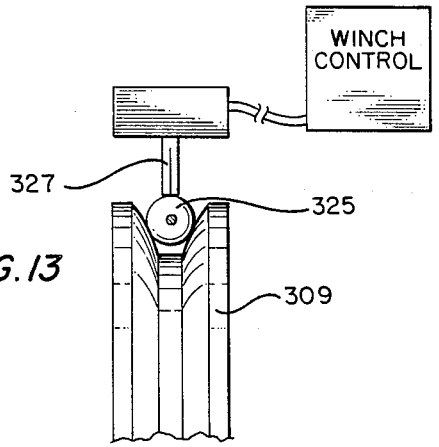
FIG. 13

EXTENSIBLE MAST

BACKGROUND OF THE INVENTION

1. Field of the Invention:

This invention relates generally to extensible and retractable members, and, specifically, to such members and a method of forming the same for use as rigid supports, as in the case of aerial mast and antennae.

2. Description of the Prior Art:

Many types of extensible and collapsible members are known, such as antennae used in communication, support platforms used in harvesting fruit, booms used in inspecting and servicing machinery, elevators for fire hoses, and the like.

The typical prior art device utilized a telescoping action which resulted in several inherent problems. These problems included the length of span and span strength, the support or reinforcement provided by a adjacent spans, and the number of spans needed to effect a desired amount of extension.

U.S. Pat. No. 4,625,475, "Extensible Mast" to Henry J. McGinnis, issued Dec. 2, 1986, showed an improved extensible mast which utilized a plurality of tape reels mounted on a portable base. Guide rollers on the base received the respective longitudinal edges of tape dispensed from the tape reels and oriented the tape whereby the tapes were fed upwardly by a drive mechanism in planes parallel to a central, vertical axis to form a rigid structure. A geared winding mechanism, including a plurality of rotatable windings, was located above the drive mechanism and wrapped a wrap material about the rigid structure to reinforce the structure as it was being erected.

The apparatus shown in U.S. Pat. No. 4,625,475 provided an extensible and collapsible mast which was strong and rigid when extended and which was free from problems associated with the telescoping action. The present invention in directed to further improvements in such an extendible mast, particularly with regard to an improved drive means for erecting and collapsing the rigid structure which is erected by orienting and successively uniting similar flexible strips of material which can be retracted by successively disassembling the same strips.

The device of the invention features a geared winding mechanism located beneath the drive mechanism and above the guide rollers whereby the flexible strips are wound after being oriented and united but prior to encountering the improved drive mechanism.

The combined features of the present invention provide an extensible mast or antenna which is erectable from a portable base and which has a very small volume or bulk when retracted for ease of transportation. The improved mast or antennae is strong and rigid and free from the problems associated with the prior art devices.

SUMMARY OF THE INVENTION

The extensible mast of the invention includes a plurality of tape reels mounted upon a base and angularly oriented thereon with respect to a common, vertical axis. Each of the tape reels receives a resilient metal tape having serrated, longitudinal edges for winding and unwinding the tape. Guides means located on the base receive the respective edges of the metal tape for orienting the tape, whereby the tapes are fed upwardly in planes parallel to the vertical axis at an angle to each other to form a rigid structure. An improved drive means on the base engages the serrated edges of the metal tapes for driving the tapes upwardly. Winding means, located on the base above the guide means and below the drive means, dispense a reinforcing winding simultaneously with the upward movement of the tapes for strengthening the rigid structure.

Preferably, the guide means comprise a plurality of guide rollers arranged on the base for receiving the longitudinal edges of the metal tape. The improved drive means includes a drive chain having an interior track, an exterior track and a plurality of spaced rollers located therebetween for engaging the serrated edges of the metal tape. The serrated edges of the metal tape preferably form spaced semi-spherical openings. The spaced rollers in the drive chain include spherical beads, each bead being set at a preselected distance to engage a respective semi-spherical opening for urging the metal tape upwardly.

A solid, riser block is provided for initially receiving the metal tapes as they pass from the guide rollers for orienting the tapes prior to encountering the drive means. The riser block has serrated edges which include spaced semi-spherical openings adapted to align with the semi-spherical openings in the longitudinal edges of the metal tape. The spherical beads in the drive chain are adapted to overlay the semi-spherical openings in the metal tapes and in the riser block for urging the metal tape upwardly.

A load bearing support frame is engagable about the rigid structure once the rigid structure is erected for supporting the rigid structure on the base and relieving the load of the rigid structure on the drive means. Preferably, the load bearing support frame in a triad made up of three angularly oriented vertical members joined by horizontal struts. Each of the vertical members has interior, vertical channels for receiving the respective longitudinal edges of the metal tape. The vertical members have spaced horizontally aligned openings which align with the semi-spherical openings in the longitudinal edges of the metal tape and with the semi-spherical opening in the riser block. A plurality of cross-members are received within the spaced horizontally aligned openings in the support frame and through the longitudinal edges of the metal tapes for supporting the rigid structure on the base.

Preferably, each tape reel includes a cylinder and opposing rims, each opposing rim, having a knurled exterior. Each tape reel is driven by a split clutch having a knurled hub at each end thereof. Each knurled hub is adapted to engage a respective knurled rim of a tape reel for turning the reel and dispensing the tape.

At least one guide wire dispenser is mounted on the base and a mounting member attaches an end of the guy wire to the rigid member as the rigid member is erected. Counting means, associated with each guy wire dispenser, continuously track the length of wire dispensed to insure that equal lengths of wire are dispensed from each guy wire dispenser as the tower is being erected.

Additional objects, features and advantages will be apparent in the written description which follows.

BRIEF DESCRIPTION OF THE DRAWINGS

FIG. 5 is a top view of the base of FIG. 2 showing the angular orientation of the tape reels with respect to the common vertical axis.

FIG. 6 is a perspective view of a portion of the drive chain used with the drive means of the invention and which is schematically illustrated in FIG. 4.

FIG. 11 is a simplified view of the guy wire dispenser of the invention.

FIG. 12 is a simplified, side view of the guy wire dispenser pf FIG. 11 showing the switching means thereof.

FIG. 13 is an isolated view of the counting means used with the guy wire dispenser of FIG. 11.

DESCRIPTION OF THE PREFERRED EMBODIMENT

Figure 1:
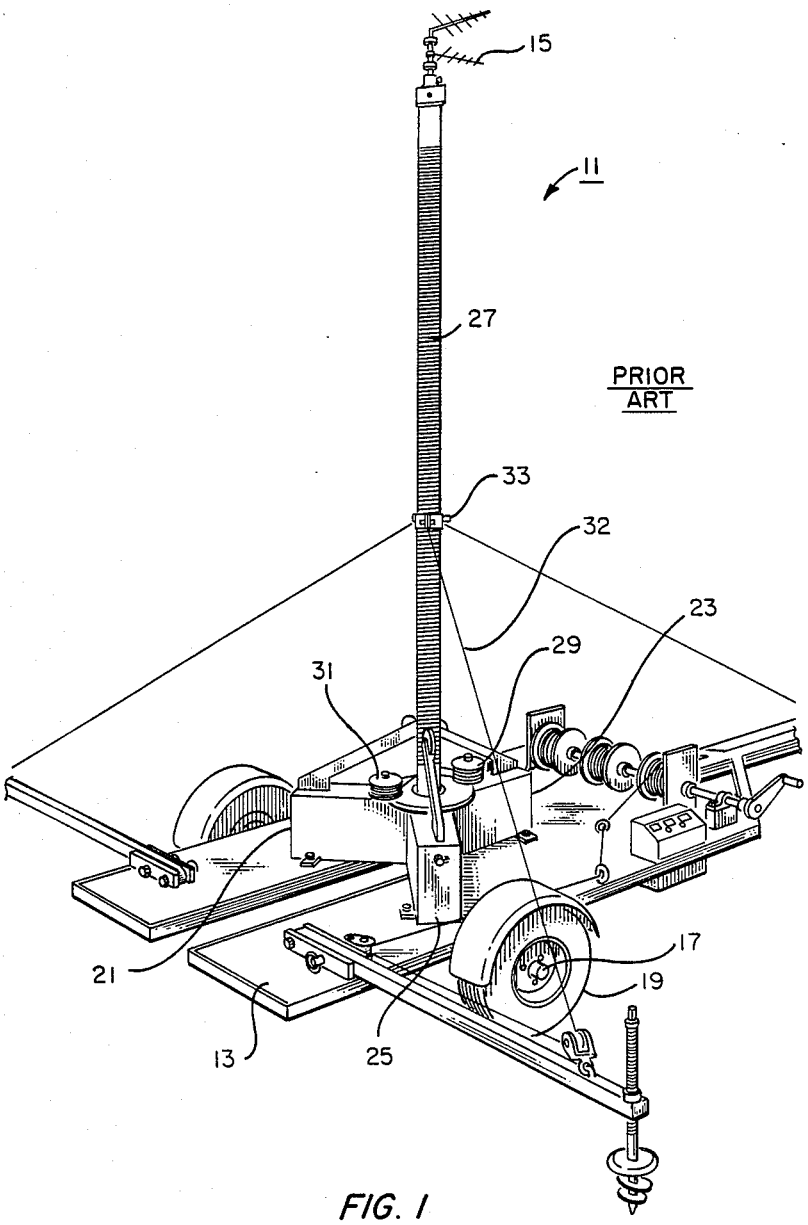
FIG. 1 shows the prior art extensible mast.

FIG. 1 shows Applicant's prior art extensible mast designated generally as 11. The mast 11 is erected from movable trailed 13 to support an antenna 15. The base 13 is provided as a trailer having an axle 17, wheels 19 and having a conventional hitch (not shown) for towing behind a vehicle. The trailer base 13 has mounted thereon a plurality of tape reel housings 21, 23, 25 which are angularly oriented thereon with respect to a common vertical axis. Each tape reel housing has rotatably mounted therein a tape reel which is adapted to receive a resilient metal tape 27. A drive mechanism dispenses tape from each reel. A plurality of rotatable windings 29, 31 are located above the drive mechanism and rotate about the vertical axis as the tape is being dispensed to wrap a wrap material about the rigid structure which is being formed. One or more guy wires 32 are dispensed from the base and are attached by a mounting member 33 to the rigid mast.

Figure 2:
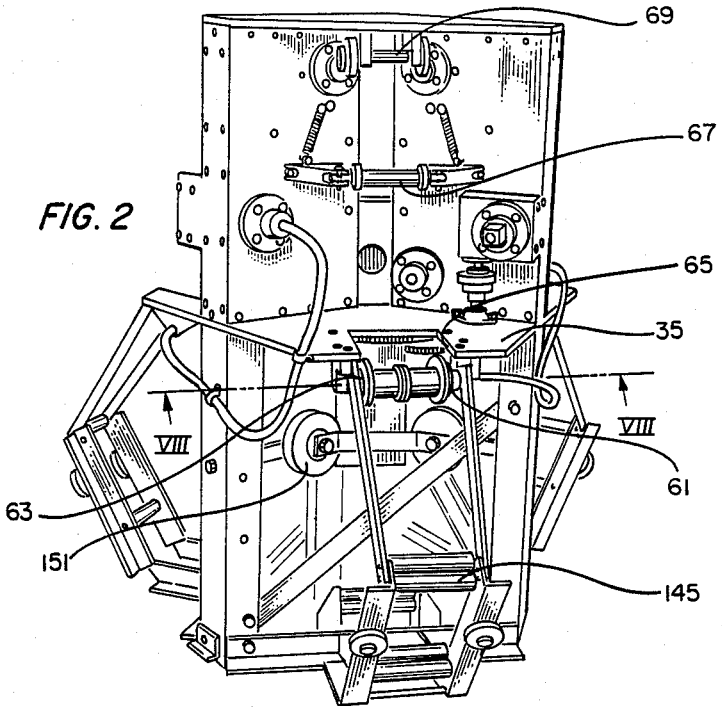
FIG. 2 is a front perspective view of the base used to dispense rigid structure of the invention with the tape reels removed for ease of illustration.
Figure 3:
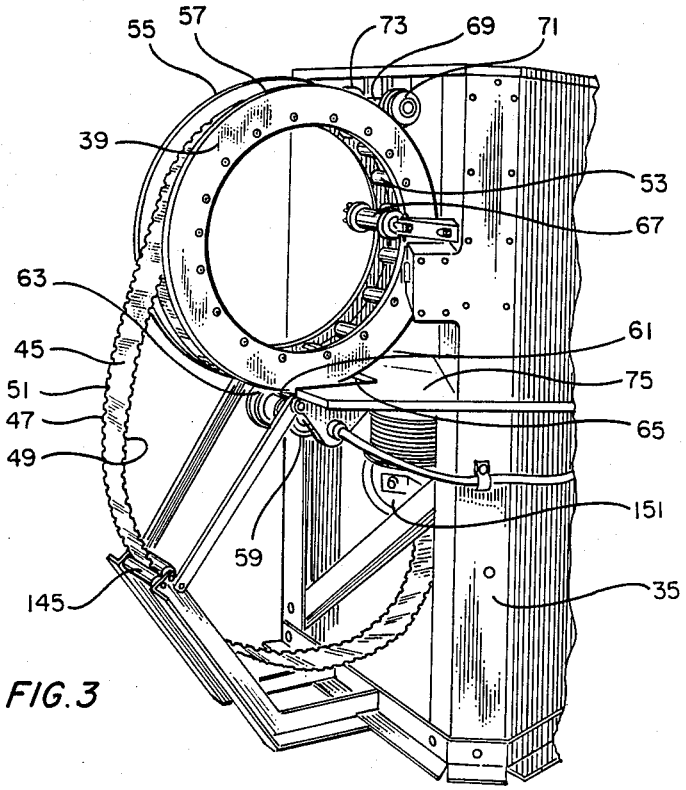
FIG. 3 is a side perspective view of the base of FIG. 1 showing one of the tape reels in place on the base.

FIGS. 2 and 3 show the improved apparatus of the invention. The apparatus includes a vertically upstanding base 35 having three tape receiving openings 65. The base 35 can conveniently be mounted on a trailer, such as trailer 13 in FIG. 1, for towing behind a vehicle. Each of the tape receiving openings on the base 35 is adapted to receive a tape reel for angularly orienting the reels with respect to a common, vertical axis (37 in FIG. 5). Each reel 39, 41, 43 is adapted to receive a resilient metal tape (45 in FIG. 3) having longitudinal edges 47, 49. As shown in FIG. 5, the edges of the tape abut, but do not interlock. The tape 45 is preferably made of flat sheet steel which has previously been decoiled, straightened, and heat treated into a flattened position, and then recoiled onto a suitable reel of sufficient diameter so as to allow stresses which will not permanently set the steel. The coiled sheets may either be straightened into flat ribbons of steel or may be rolled into a flat ribbon configuration which is slightly concave before heat treating.

The tape 45 of the present apparatus differs from that used in the prior art in that the longitudinal edges 47, 49 are serrated. Preferably, the tape edges 47, 49 form spaced semi-spherical openings 51 (see FIG. 4) which are adapted to be engaged by the drive means of the apparatus. For a metal tape having a six inch width, the center to center spacing of the semi-spherical opening is approximately 1½".

Figure 7:
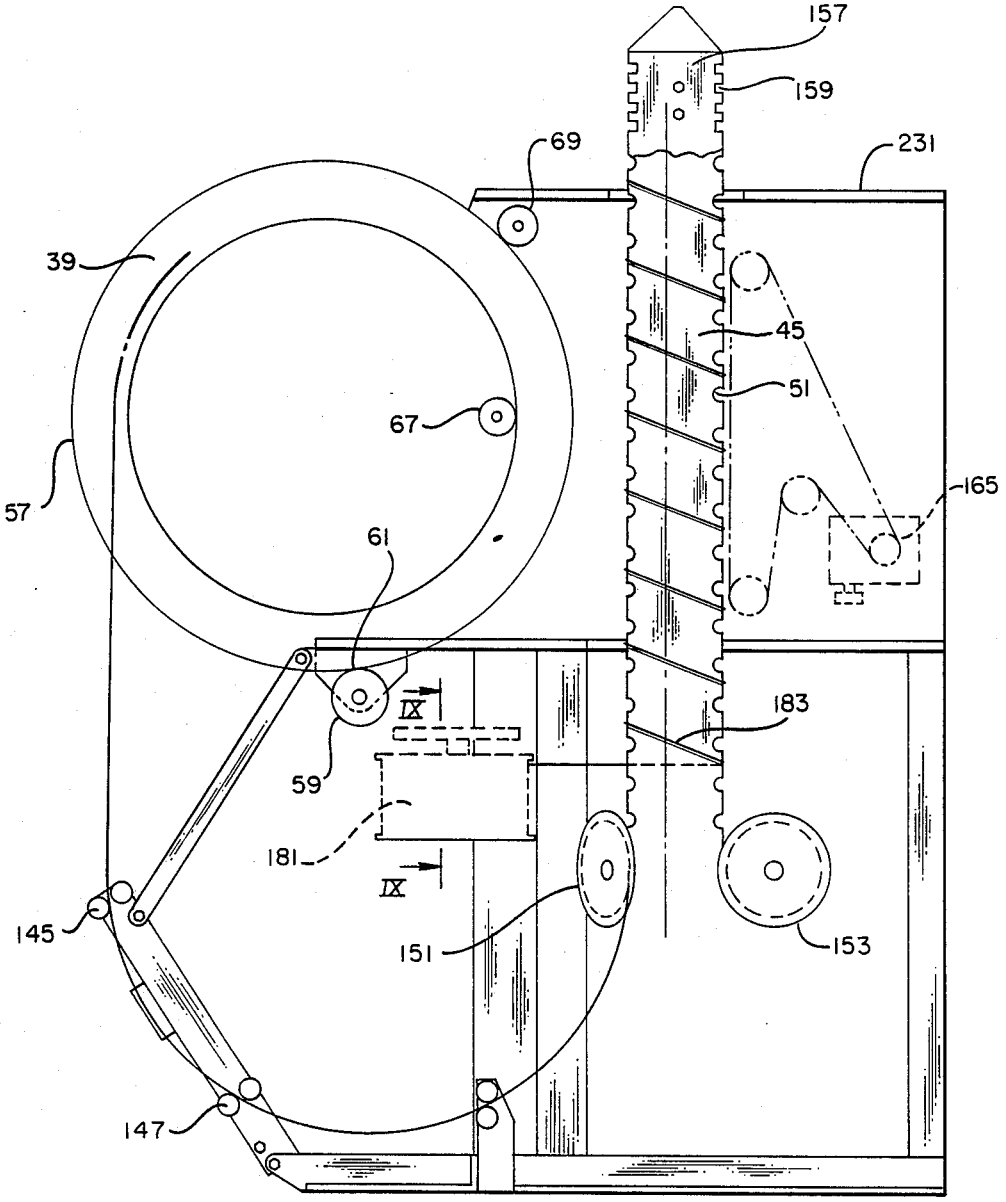
FIG. 7 is simplified, schematic view illustrating the operation of the drive means and winding means of the invention the drive chain illustrated in FIG. 6 is shown in dotted lines in FIG. 7 for clarity.

Each tape reel 39, 41, 43 (FIG. 3) includes a cylindrical portion 53 and opposing rims 55, 57. Each opposing rim 55, 57 has a knurled exterior. As shown in FIGS. 3 and 7, each tape reel 39, 41, 43 engages a split clutch 59 (to be described) having a knurled hub 61, 63 at either end thereof. The knurled hubs 61, 63 are adapted to engage the knurled rims of the respective tape reel at its lower extent for driving the reel. Each tape reel is retained within its respective opening 65 by a retainer, such as cross-piece 67 which is hinged at one end. A spool 69 is mounted on the base above the cross-piece 67 and has opposing hubs 71, 73 to engage the rims 55, 57 of the reel at its upper extent.

Figure 8:
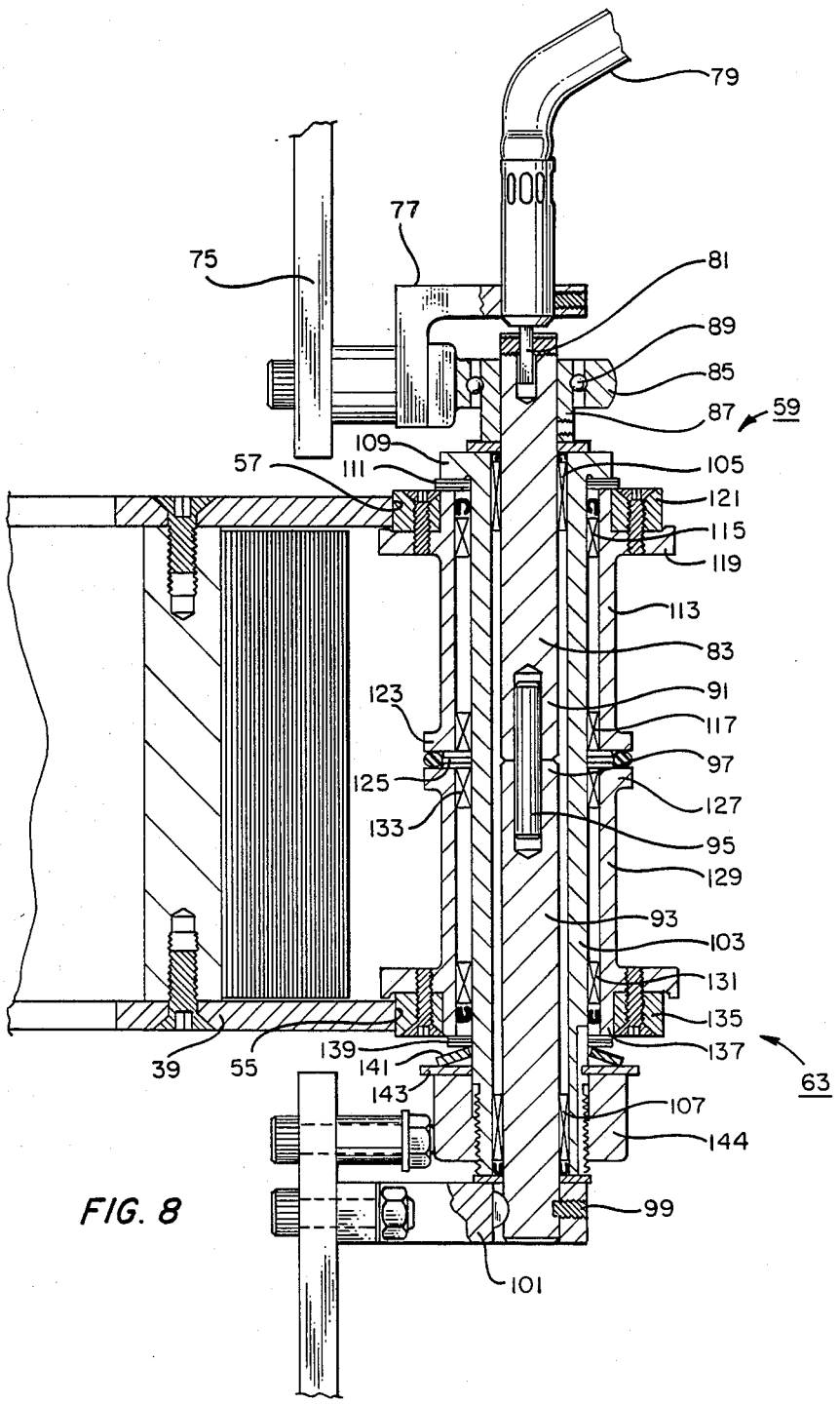
FIG. 8 is a cross-sectional view of the split clutch used to drive the tape reels on the base of FIG. 2 and is taken along the VIII—VIII of FIG. 2.

FIG. 8 shows the split clutch 59 used to turn the tape reels 39, 41, 43. The split clutch 59 is supported from the base plate 75 by means of a bracket 77. A flexible drive cable 79, driven by the drive means, has a rotatable center shaft 81. The shaft 81 is keyed within a mating bore provided in one end of a driven shaft 83. The driven shaft 83 is received, at one extent, within a bearing race 85 including an inner collar 87 and a plurality of balls 89, for allowing rotation of the driven shaft with respect to the bracket 77.

The left (as shown in the drawing) extent 91 of the driven shaft 83 is coupled to a stationary shaft 93 by means of an internal pin 95 received within mating bores provided in the left extent 91 and the right extent 97 of the stationary shaft 93. The stationary shaft 93 is fixed in position by means of a set screw 99 provided in the lower mounting 101.

A common sleeve 103 surrounds the driven shaft 83 and stationary shaft 93 and is spaced apart therefrom by a one way bearing 105, 107 at opposite extents thereof. The common sleeve 103 also includes a flange 109 which rests upon a plurality of hard, smooth surface washers 111. Surface washers 111 bear against one extent of an outer cylinder 113. The outer cylinder 113 is spaced apart from the common sleeve 103 by means two way bearings 115, 117. Outer cylinder 113 includes and outer flange 119 which supports the outer knurled hub 121 and an inner flange 123 which is separated by surface washers 125 from the inner flange 127 of an oppositely arranged outer cylinder 129. Outer cylinder 129 is spaced apart from the common sleeve 103 by two way bearings 131, 133 and supports the outer knurled hub 135. Cylinder 129 also includes an outer extent 137 upon which a plurality of surface washers 139 are carried. The surface washers 139, contact a spring washer 141 which in turn, rides upon a tongue washer 143.

The tongue washer 143 is retained about the common sleeve 103 by means of a threaded nut 144. The threaded nut 144, when tightened, bears against the tongue washer 143 and the spring washer 141 which in turn, bears against the surface washers 139 to provide frictional engagement with the outer extent 137 of the common sleeve 103. Rotation of the center shaft 81 drives the driven shaft 83 which turns the outer cylinder 123, 129 and causes the knurled hubs 121, 135 to drive the reel 39.

As the tape is dispensed from each reel (39 in FIGS. 3 and 7) it passes through pinch rollers 145, 147 to three angularly oriented guide rollers (151, 153, 155 in FIG. 5). As shown in FIG. 7, the guide rollers receive the respective longitudinal edges 55, 57 of the tape for orienting the tapes. In this way, the tapes are fed upwardly in planes parallel to the vertical axis 37 of the mast at an angle to each other to form an equilateral triangle.

In order to further facilitate the orientation of the tape 27, a riser block 157 is provided for positioning the tape in triangular shape. Riser block 157 is an equilateral, triangular mandrel having serrated edges 159 adapted to mate with the serrated edges 51 of the tape. The riser block 157 is approximately 3 ft. in overall length and eventually forms the top extent of the rigid structure.

Figure 4:
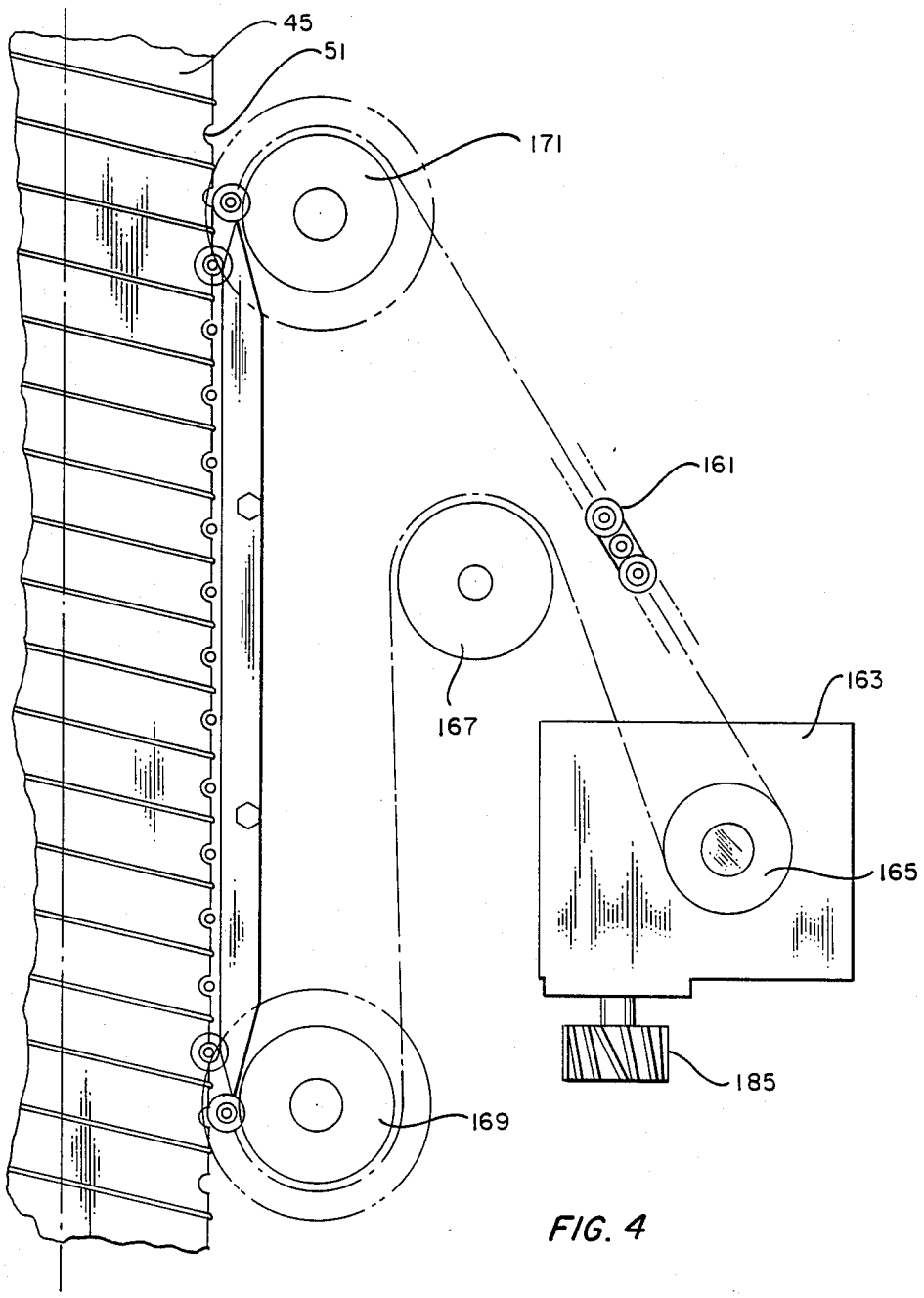
FIG. 4 is a side, simplified view of the drive means used to engage the serrated edges of the metal tapes for driving the metal tapes upwardly.

FIG. 4 shows the drive means located on the base for engaging the serrated edges 51 of the metal tapes for driving the tapes upwardly. The drive means is located above the guide rollers (see FIG. 7). The drive means includes a drive chain 161 driven by a motorized chain drive 163 having a drive sprocket means 165. The drive chain 161 passes about rollers 167, 169, 171 which are rotatably mounted on the base for aligning the drive chain 161 with the semi-spherical opening 51 in the tape 45. For clarity, the drive chain 161 and rollers 167, 169, 171 are shown in dotted lines in FIG. 7.

FIG. 6 shows the drive chain in greater detail. The drive chain includes a track 173 and a track 175 and a plurality spaced rollers 177 located therebetween for engaging the serrated edges 51 of the metal tapes 45. As shown in FIG. 4, the metal tape serrated edges form spaced semi-spherical openings and the spaced rollers in the drive chain 161 include spherical beads 179, each bead being set at a preselected distance to engage a respective semi-spherical opening 51 for urging the metal tape upwardly. The serrated edges 159 of the riser block 157, mate with the semi-spherical openings in the longitudinal edges of the metal tapes and the spherical beads 179 in the drive chain are adapted to overlay the semi-spherical openings in the metal tapes 45 and the riser block 157.

At least one wrapping reel 181 (FIG. 7) is mounted on the base above the guide rollers 151, 153, 155 and below the drive means and contains a reinforcing winding 183. Winding means are provided for orbiting the wrapping reel 181 about the mast as the mast moves upwardly and downwardly for dispensing and rewinding the reinforcing winding 183 about the mast. As shown in FIG. 7, the winding 183 is wrapped about the rigid mast between the semi-spherical openings 51 provided in the longitudinal edges of the tape.

Figure 9:
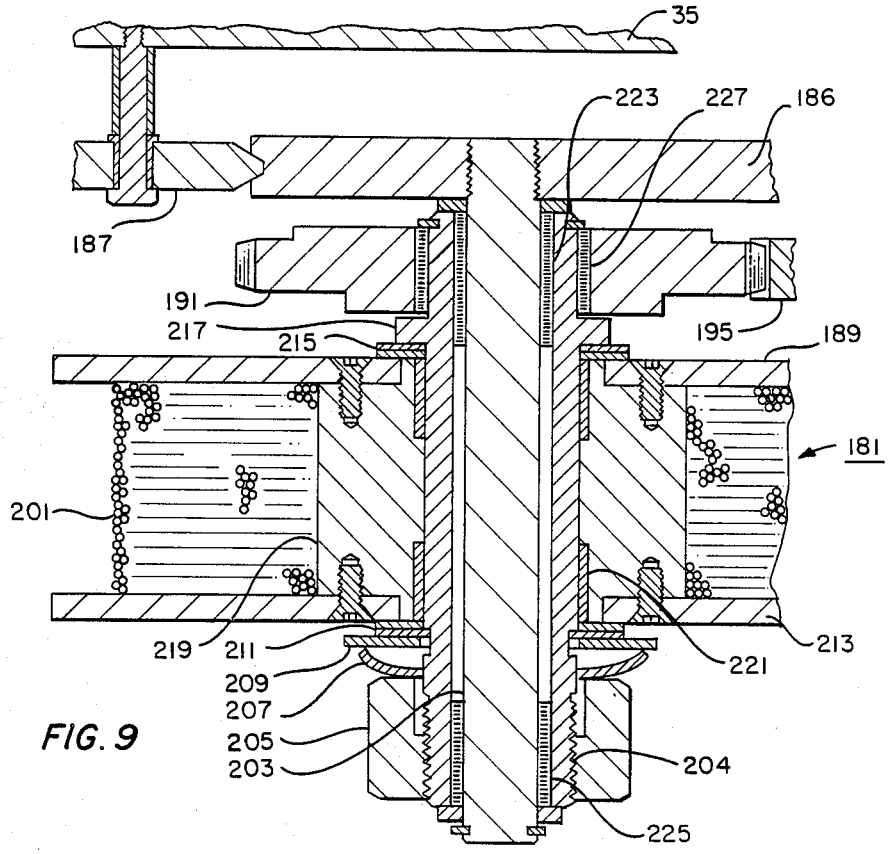
FIG. 9 is a cross-sectional view of the winding means used for dispensing a reinforcing winding about the tape taken along the lines IX—IX of FIG. 7.

FIG. 9 shows the winding means used for dispensing the reinforcing winding simultaneously with the upward movement of the tape 45. The chain drive 163 (FIG. 4) includes a spur gear 185 (FIG. 4) whose movement is synchronized with the drive sprocket 165 and which includes external teeth for engaging a mating drive surface (not shown) of a rotatable plate 186. Three idler wheels 187 located on the base 35 rotatably support the plate 186 about the peripheral edges thereof. The plate 186 has mounted thereon one or more rotatable reels 189, preferably two. Each of the rotatable reels 189 has a planetary gear 191 on its upper end which contacts and matingly engages the teeth on the exterior of a stationary sun gear 195. The sun gear 195 is stationarily mounted on a support member which extends within the central opening in the rotatable plate 186 and is mounted to the base. The winding means is further described in my prior U.S. Pat. No. 4,625,475, the disclosure of which is hereby incorporated by reference.

Wrap material 201, wound around reels 189 can consist of thin aircraft cable, mylar or fiberglass tape, or other combinations of tape, wire or suitable material to bind the pieces of tape 45 together. For example, one reel 189 can contain tape, while the other winding contains wire, or both can contain tape or wire. The reels 189 have overrunning means, described subsequently to keep the wrapped material tight as it spins around the mast as the mast is being deployed from or retracted from the apparatus.

The overrunning clutch means for the reels 189 includes a stationary shaft 203 that is rigidly secured in rotating plate 186 so that it will rotate about the axis of the mast with the plate 186. A cylindrical hub 204 is carried on the outside of the shaft 203. A nut 205 is secured to the threads at the top of the hub 102. Nut 205, when tightened, bears against a beveled spring 207. Spring 207 bears against a tongue washer 209 that encircles the hub 204. Tongue washer 209 will move axially along the length of the hub 204. However, it is locked to the hub 204 for rotation therewith by inwardly protruding tabs located in the slots in the hub 204.

Tongue washer 209 bears against a pair of hard, smooth surface washers 211. Washers 211 are located between the tongue washer 209 and the reel flanges 213. There is a second set of smooth, hard surface washers 215 located on the upper side of the reel flanges, and spaced between the reel flanges and a flange 217 formed on the hub 204. Washers 211, 215 are not rigidly locked to the hub 204 or the reel flanges 213, but cause the reel flanges 213 to rotate with the hub 204 due to frictional force from the beveled spring 207, until this frictional force is overcome. The reel flanges 213 are secured to a central cylinder 219, which has bronze bushings 221 on the inside for accommodating rotation of the reel 189 relative to the hub 204.

Upper and lower overrunning hub clutches 223, 225 are located between the shaft 203 and the hub 204. Hub clutches 223, 225 lock the hub 204 and the shaft 203 together when the hub 204 is being rotated in the direction that occurs while the mast is moving upward. While the mast is moving downward, the overrunning clutches 223, 225 allow free rotation of the hub 204 with respect to the shaft 203. There is also an overrunning gear clutch 227 located between the gear 191 and the hub 204. Clutch 227 locks the gear 191 to the hub 204 when the gear 191 is being rotated in the direction while the mast is going down. When the mast is going up, the clutch 227 allows free rotation of the gear 191 relative to the hub 204. Clutches 223, 225 and 227 are conventional clutches which allow rotation in one direction, but prevent rotation in the opposite direction.

Figure 10:
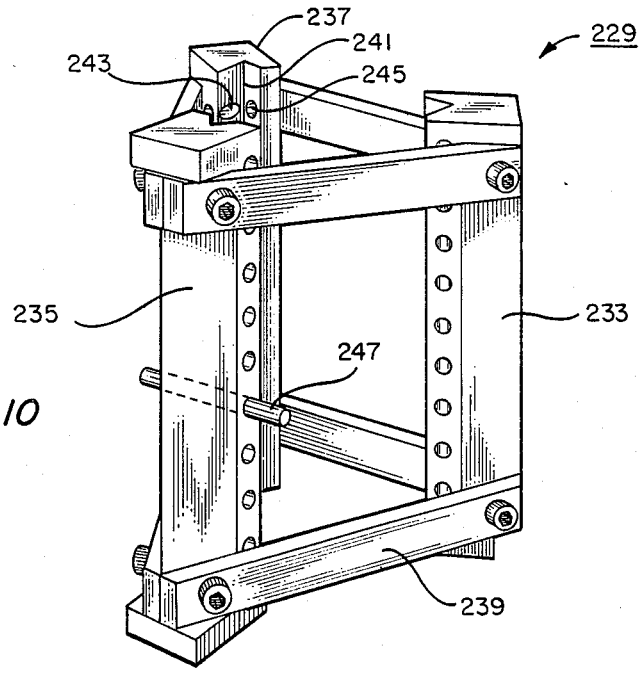
FIG. 10 is a perspective view of the load bearing support frame used to support the erected rigid structure on the base of FIG. 2 and is not shown in the other views as the guy wires are attached only as the mast is erected to selected heights.

FIG. 10 shows a load bearing support frame, designated generally as 229 which is engagable about the rigid mast for supporting the mast on the base upper surface (231 in FIG. 7) to relieve the load of the rigid mast on the drive means of the apparatus. As shown in FIG. 10, the support frame 229 is a triad made up of three angularly oriented vertical member 233, 235, 237 joined by horizontal struts 239. Each of the vertical members has an interior, vertical channel 241 for receiving the respective longitudinal edges of the metal tape 45. The vertical members 233, 235, 237 have spaced horizontally aligned openings 243, 245 which align with the semi-spherical openings 51 in the longitudinal edges of the metal tape 45 and with the semi-spherical openings 159 in the riser block 157. A plurality if cross-members, such as dowel pins 247, are received within the spaced horizontally aligned openings 243, 245 in the support frame and through the longitudinal edges of the metal tapes for supporting the rigid structure on the base.

With reference now to FIGS. 11, 12 and 13, the method and apparatus utilized to stabilize mast during erection, utilization and retraction is depicted. As can be seen, FIG. 11 depicts a winch 301 having a spool 303 which preferably serves to store a length of beaded cable 305. Beaded cable 305 is preferably a wire cable having suitable tensil strength which includes a plurality of metal or plastic beads which are affixed onto the cable at regular intervals. Wench 301 is preferably an electrically powered winch which may be simply and easily controlled in accordance with the present invention, and which mounted, as depicted, on the support platform 307. Platform 307 can, for instance comprise a portion of the portable trailer on which base 35 is mounted.

It should be apparent to those skilled in the art of mast erection that in order to maintain a mast in an erect position it is generally preferable to utilize at least 3 guy wires or supports which should be maintained in substantially equidistant locations surrounding the mast. For instance, see guy wires 32 in FIG. 1. Of course, four or more guy wires may be utilized and multiple sets of guy wires affixed to the mast at different heights may also be utilized.

As is illustrated in FIG. 11, beaded cable 305 is payed out from each spool (only spool 303 is shown) and is coupled, via metering pulley 309 to a point of fixation at the rising mast (see 33 in FIG.1). Metering pulley 309 is preferably mounted above platform 307 by means of stanchion 311.

Referring now to FIG. 12 an important feature of the mounting of winch 301 is depicted. As can be seen, winch 301 is preferably pivotally mounted to structural member 307 at hinge point 313. Hinge point 313 is pivotally affixed to structural member 307 utilizing bolts 315 and the winch is then affixedly mounted at its other end to structural member 307 by means of spring shaft 317 and spring 319. In this manner, axial tension along beaded cable 305 will pivot winch 301 about hinge point 313, to the extent permitted by compression of spring 319. Thus, by placing a suitable switch device 321 under the mounting pad 323 of winch 301, it is possible to generate an electrical signal which in indicative of the presence or absence of axial tension along beaded cable 305.

With reference now to FIG. 13, the operation of metering pulley 309 is depicted. As is illustrated, each bead 325 on beaded cable 305, as it passes metering pulley 309, will mechanically actuate a cable displacement switch 327. In this manner it is possible to accurately and easily measure the displacement of each span of beaded cable as it is payed out from its associated spool. Those skilled in the art of such controls will appreciate that winch control may then be implemented utilizing any suitable micro-processor device and that a simple program may be written to control the operation of multiple electrical winches in accordance with the measurement of cable displacement associated with each winch, as well as the presence or absence of axial tension along each guy wire. Assume, for instance, that in a three winch system, winch one dispenses one equivalent bead length of cable. The winch control would shut off winch one until winches two and three had similarly counted out one equivalent bead length of cable.

In similar manner, it will be appreciated that the winch control can be utilized to compensate for those situations in which it is not possible to place each winch equidistant from the point of mast erection by a simple alteration to the program which controls the relative displacement of each beaded cable from its associated spool. This may be necessary where, for instance, the terrain is uneven. Similarly, it should be apparent that this technique may be utilized during mast retraction to insure that equal tension is maintained on each guy wire to promote the safe retraction of an elevated mast.

The overall operation of the mast will now be described. Referring to FIG. 3, the split clutch 59 is powered on causing the metal tape 45 to be dispensed from the reel 39. The tape 45 passes through pinch rollers 145 on its way toward the guide rollers 151. The riser block 157 is lowered by means of the chain drive (FIG. 4) so that the lower extent thereof extends below the guide rollers 151, 153, 155. This allows the free ends of the metal tape 45 to be attached to the riser block. Referring to FIG. 4, the chain drive 163 is then powered on causing the drive chain 161 to engage the openings 151 in the longitudinal edges of the riser block 157. The tape passes upwardly through the guide rollers and in oriented to form an equilateral triangle which is forced upwardly along a vertical axis. Movement of the chain drive 163 and the spur gear 185 drives the rotatable plate 186. As has been described, the movement of the plate 186 causes reels 189 to spin about the stationary gear 195, so that the reels rotate about the vertical axis of the mast to wrap the mast with a reinforcing winding 201 as the mast is being erected.

To prevent the line from breaking, the beveled spring 207 provides frictional force on the washers 211, 215 to allow the reel 189 to slip as the line is wound about it. This slight slippage places the line under the same amount of tension that occurs when the line 201 was being wrapped around the mast. Consequently, reel 189 slides under friction due to the beveled spring 207 both while the cable is being pulled from the reel, and also while the line is being wrapped around the reel 189. Slippage of the reel 189 with respect to the hub 204 thus occurs in both directions. In one direction, the hub 204 will rotate, but at a faster rate than the reel can rotate, while in the other direction, the hub 204 will not rotate.

As the mast is moving upwardly, the rotatable plate 186 causes the reels 189 to orbit the mast. The sun gear 195 is always stationary. The gear 191 rotates, but due to clutch 227, its rotation will have no effect on the hub 204. Also, the clutches 223, 225 will lock the hub 204 to the shaft 203, which is stationary. The reel 189 will rotate only due to the wire 201 being pulled off and wrapped about the mast. To maintain tension, the beveled spring 207 pushes against the tongue washer 209, which in turn compresses the washers 211, 215, providing a desired frictional force to cause the wire to tightly wrap.

At the mast is being erected, the guy wire is played out from the respective winches on the platform to provide additional stability for the mast. When the mast has been fully erected, the load bearing support frame 229 can be disassembled, positioned about the mast and reassembled. The dowel pins 247 can be inserted through the aligned openings 243, 245 to support the mast upon the upper surface 231 of the base and relieve the load on the drive system.

When the mast is being retracted, the direction of the chain drive is reversed, thus rotating plate 186 in the opposite direction. Reels 189 orbit about the mast in the opposite direction. Gear 191 will rotate due to its engagement with the stationary sun gear 195. This time, the gear clutch 227 locks the gear 191 to the hub 204 for rotation therewith. Conversely, the hub clutches 223, 225, because of the reverse direction, allow free rotation of the hub 204 around the shaft 203. To assure that the line is pulled tightly about the reel 189 under the same tension that occurred while the line was being wound onto the mast, the gear ratio between the gear 191 and sun gear 195 is selected to rotate the reel 189 faster than it can draw the line from the mast. It can draw the line from the mast only as the mast moves downwardly since the mast does not rotate.

An invention has been provided with several advantages. The extensible mast of the invention can be hauled to remote locations upon a portable base. The The size and compact nature of the collapsed mast facilitate transportation. The reinforcing windings provide additional stability for the mast which eliminates the need for extensive guying. The erection process can be simply reverse to retract the mast and rewind the reinforcing wrap material.

While the invention has been shown in only one of its forms, it is not thus limited but is susceptible to various changes and modifications without departing from the spirit thereof.

I claim:

1. An extensible mast, comprising:

a plurality of tape reels rotatably attached upon a base and angularly oriented thereon with respect to a common, vertical axis of the base, each of said tape reels receiving a resilient metal tape having serrated, longitudinal edges for winding and unwinding said tape;

guide means located on said base receiving the respective edges of said metal tapes and for orienting said tapes with said serrated edges touching each other whereby said tapes are fed upwardly in planes parallel to said vertical axis and at an angle to each other to form a rigid structure;

drive means on said base above said guide means, and in contact with said serrated edges for engaging said serrated edges of said metal tapes for driving said tapes upwardly; and winding means located on said base above said guide means and below said drive means having a reinforcing winding connected to said rigid structure for dispensing a reinforcing winding and wrapping around said rigid structure simultaneously with the upwardly movement of said tapes for strengthening said rigid structure.

2. The extensible mast of claim 1, wherein said winding means wraps said winding around said tapes in spaces between serrations in said serrated edges.

3. The extensible mast of claim 1, further comprising:

a riser block for initially receiving said metal tapes for orienting said tapes; and wherein said riser block has serrated edges which include spaced, semi-spherical openings adapted to align with said semi-spherical openings in the longitudinal edges of said metal tapes and wherein said spherical beads in said drive chain are adapted to overlay said semi-spherical openings in said metal tapes and in said riser block for urging said metal tape upwardly.

4. The extensible mast of claim 1, wherein said drive means includes a drive chain in a continuous loop having an interior track, an exterior track and a plurality of spaced rollers located therebetween for engaging the serrated edges of said metal tapes.

5. The extensible mast of claim 4, wherein the metal tape serrated edges form spaced, semi-spherical openings and wherein the spaced rollers in the drive chain include spherical beads, each bead being set at a preselected distance to engage a respective semi-spherical opening for urging the metal tape upwardly.

6. An extensible mast, comprising:

three tape reels rotatably mounted upon a base and angularly oriented thereon 120° apart from each other with respect to a common, vertical axis of said base, each of said tape reels receiving a resilient metal tape having serrated, longitudinal edges for winding and unwinding said tape between a retracted and an extended position;

guide means located on said base receiving the respective edges of said metal tapes and for orienting said tapes with said serrated edges touching each other, whereby said tapes are fed upwardly in planes parallel to said vertical axis and at an angle to each other to form a rigid structure having a triangular cross-section;

drive means on said base above said guide means and in contact with said serrated edges for engaging said serrated edges of said metal tapes for driving said tapes upwardly;

winding means located on said base above said guide means and below said drive means having a reinforcing winding connected to said rigid structure for dispensing and wrapping around said rigid structure a reinforcing winding simultaneously with the upwardly movement of said tapes for strengthening said rigid structure; and a load bearing support frame engagable about said rigid structure and adapted to be placed on said base for supporting said rigid structure on said base, thereby relieving the load of said rigid structure on said drive means.

7. The extensible mast of claim 6, wherein the load bearing support frame is a triad made up of three angularly oriented vertical members joined by horizontal struts, each of the vertical members having a interior, vertical channels for receiving the respective longitudinal edges of said metal tape, said vertical members having spaced, horizontally aligned openings, which align with said semi-spherical openings in the longitudinal edges of said metal tapes and with the semi-spherical opening in said riser block, and wherein a plurality of cross-members are received within said spaced, horizontally aligned openings in said support frame and through the longitudinal edges of said metal tapes for supporting said rigid structure on said base.

8. The extensible mast of claim 7, further comprising:

a plurality of guy wire dispensers containing guy wire and a mounting member attaching an end of each said guy wires to said rigid member;

metering means for measuring the displacement of guy wire dispensed from each said guy wire dispenser as said rigid member is erected and for generating a metering signal; and control means for controlling the operation of each of said dispensers in response to said metering signal to synchronize the play-out of guy wire from said plurality of dispensers.

9. The extensible mast of claim 8, wherein said guy wire dispensers contain beaded cable and wherein said metering means includes a counter for counting beads on said cable as said cable passes a reference point.

10. The extensible mast of claim 8, wherein each guy wire dispenser is an electrically powered winch which is pivotally mounted at a hinge point on a support platform, whereby each said winch is pivoted about said hinge point in response to tension in said guy wire being dispensed from said winch.

11. The extensible mast of claim 10, further comprising:

switch means for controlling the operation of said winch in response to the pivotal position thereof.

12. An extensible mast, comprising:

three tape reels rotatably mounted upon a base and angularly oriented thereon 120° apart from each other with respect to a common, vertical axis of said base, each of said tape reels receiving a resilient metal tape having serrated, longitudinal edges for winding and unwinding said tape;

guide means located on said base receiving the respective edges of said metal tapes and for orienting said tapes with said serrated edges touching each other whereby said tapes are fed upwardly in planes parallel to said vertical axis and at an angle to each other to form a rigid structure having a triangular cross-section;

drive means on said base above said guide means and in contact with said serrated edge for engaging said serrated edges of said metal tapes for driving said tapes upwardly in planes parallel to the vertical axis and at an angle to each other to form a rigid mast, and winding the tapes back on the tape reels to lower the mast;

at least one wrapping reel carried on said base above said guide means and below said drive means and containing a reinforcing winding;

means located above said guide means and below said drive means and in engagement with said wrapping reel for orbiting the wrapping reel about the mast as the mast moves upwardly and downwardly and dispensing and rewinding a reinforcing winding about the mast as the mast extends and retracts;

clutch and brake means connected with the wrapping reel for applying a frictional resistance to the wrapping reel as the mast moves upwardly, drawing reinforcing winding from the wrapping reel under tension, and allowing frictional slippage of the wrapping reel as the reinforcing winding is drawn back onto the winding reel to assure rewinding under tension; and wherein each tape reel includes a cylinder and opposing rims, each opposing rim having a knurled exterior, and wherein each tape reel is driven by a split clutch having a knurled hub at each end thereof, each knurled hub being adapted to engage a respective knurled rim of a tape reel.

13. A method of erecting an extensible mast from a movable base comprising the steps of:

mounting a plurality of tape reels on said base, said reels being angularly oriented on said base with respect to a common, vertical axis, each of said tape reels being adapted to receive a resilient metal tape having serrated, longitudinal edges for winding and unwinding said tape;

mounting a plurality of guide rollers on said base for receiving the respective longitudinal edges of said metal tapes and for orienting said tapes;

feeding said tapes upwardly through said guide rollers in planes parallel to said vertical axis and at an angle to each other to form a rigid structure;

engaging said serrated edges of said metal tapes with drive means located above said guide rollers for driving said tapes upwardly in planes parallel to the vertical axis and at an angle to each other to form a rigid mast, and winding the tapes back on the tape reels to lower the mast; and mounting at least one rotatable winding on said base for dispensing reinforcing winding and rotating said winding about said vertical axis as said tapes are fed upwardly along said vertical axis and below the points at which said drive means engage said serrated edges.

* * * * *